US005785877A

United States Patent [19]

Sato et al.

[11] Patent Number: 5,785,877

[45] Date of Patent: Jul. 28, 1998

[54] DRY ETCHING METHOD

[75] Inventors: Masaaki Sato; Yoshinobu Arita, both of Atsugi; Masahiro Ogasawara, Koufu; Hidenori Satoh, Tama; Hiromitsu Kanbara, Kawasaki, all of Japan

[73] Assignees: Nippon Telegraph and Telephone Corporation; Tokyo Electron Limited, both of Tokyo, Japan

[21] Appl. No.: 799,083

[22] Filed: Feb. 11, 1997

Related U.S. Application Data

[63] Continuation of Ser. No. 459,426, Jun. 2, 1995, abandoned.

[30] Foreign Application Priority Data

Jun. 2, 1994 [JP] Japan ..... 6-142213

[51] Int. Cl.[6] ..... H01L 21/302

[52] U.S. Cl. ..... 216/67; 438/714; 438/909

[58] Field of Search ..... 216/64, 67; 156/643.1, 156/646.1; 438/714, 909

[56] References Cited

U.S. PATENT DOCUMENTS

| | | | |
|---|---|---|---|
| 4,374,698 | 2/1983 | Sanders et al. | 156/643 |
| 4,468,285 | 8/1984 | Bayman et al. | 156/643 |
| 4,505,782 | 3/1985 | Jacob et al. | 156/643.1 |
| 4,595,484 | 6/1986 | Giammarco et al. | 216/66 |
| 4,620,208 | 10/1986 | Fritzsche et al. | 357/23.1 |
| 5,047,115 | 9/1991 | Charlet et al. | 156/643.1 |
| 5,160,407 | 11/1992 | Latchford et al. | 156/656 |
| 5,203,956 | 4/1993 | Hansen | 216/79 |
| 5,256,245 | 10/1993 | Keller et al. | 156/643.1 |
| 5,259,923 | 11/1993 | Hori et al. | 156/643 |
| 5,318,665 | 6/1994 | Oikawa | 156/643.1 |
| 5,354,417 | 10/1994 | Cheung et al. | 156/643.1 |
| 5,512,515 | 4/1996 | Takeuchi et al. | 438/681 |
| 5,560,804 | 10/1996 | Higuchi et al. | 156/643.1 |
| 5,618,754 | 4/1997 | Kasahara | 156/643.1 |

OTHER PUBLICATIONS

Tsuchizawa et al "Influence of Reaction Products and Oxygen on Highly Selective Electron Cyclotron Resonance Ion Stream Etching of Si" Jpn. J. Appl. Phys., vol. 11, Pt. 1, No. 10, pp. 6019–6024, Oct. 1994.

*Primary Examiner*—Robert Kunemund
*Assistant Examiner*—Anita Alanko
*Attorney, Agent, or Firm*—Oblon, Spivak, McClelland, Maier & Neustadt, P.C.

[57] ABSTRACT

An object to be etched is loaded in a low-pressure vapor phase processing chamber, and then an etching gas obtained by adding a small amount of additive gas of oxygen or additive gas at least containing oxygen to a reaction gas used for etching is fed to the low-pressure vapor phase processing chamber so as to suppress a reaction between the wall of the low-pressure vapor phase processing chamber and the reaction gas. In this state, the object to be etched is dry-etched with the etching gas.

11 Claims, 4 Drawing Sheets

DRY ETCHING METHOD

This application is a Continuation application of application Ser. No. 08/459,426, filed on Jun. 2, 1995, now abandoned.

BACKGROUND OF THE INVENTION

1. Field of the Invention

The present invention relates to a dry etching method of causing silicon or its compound used as a functional material, a metal used as a wiring material, or the like to react in a vapor phase, thereby removing it, in the manufacturing process of a semiconductor device.

2. Description of the Related Art

A wet etching method of causing an oxidation-reduction reaction or dissolution reaction with an aqueous acid or alkali solution to perform etching is known as an etching method of a metal or its compound.

According to this method, almost all the metals and their compounds can be etched by selecting the types of acids and alkalis and combinations of concentrations of these materials.

In selective etching with a mask, however, since wet etching does not have an etching directivity, the lower end portions of the mask are undesirably etched, i.e., undercut occurs.

Under the conditions of the occurrence of undercut, it is very difficult to form a pattern having a width twice or less the thickness of the material of a target object.

To solve this problem, there is proposed a reactive ion etching method as dry etching having an etching directivity.

This is a method in which the incident direction of ions on an object to be etched is given the anisotropy by the interaction of ions having a directivity in a vapor phase and a gas decomposed and excited with a plasma.

For example, silicon-based materials such as single-crystalline silicon, polysilicon, silicon oxide, and silicon nitride, metals such as aluminum, titanium, tungsten, molybdenum, and copper, and metal compounds such as CuAl, GaAs, InP, tungsten silicide, and titanium silicide can be anisotropically etched using a halogen element gas or halogen-element-containing gas.

In a dry etching apparatus for performing such etching, an etching chamber for performing processing has roles of a vacuum vessel for keeping the processing environment in vacuum and of an RF discharge electrode used for plasma generation and ion acceleration. For this reason, a metal vessel, and particularly stainless steel and aluminum vessels are mainly used as the etching chamber.

In recent years, since heavy metal contamination to a semiconductor device to be processed greatly lowers the performance of the semiconductor device, development of a vessel which can minimize contamination becomes important. As a vessel meeting this need, an etching chamber formed of aluminum whose surface is alumite-treated (anodized) has been frequently used. In this chamber, even if aluminum is deposited on a semiconductor device, the deposition can be relatively easily removed by a wet etching method. Further, even if aluminum permeates into a semiconductor device, this hardly causes degradation of the performance of the semiconductor device.

It is generally considered that a reaction between a chlorine or bromine gas used as an etching gas and aluminum can be prevented by anodizing the surface of aluminum to obtain alumina.

In the conventional dry etching described above, gases used for etching are supplied from gas cylinders in which the gases are filled. However, the following problems arise from such gas cylinders.

In the conventionally used gas cylinder, impurities, and particularly oxygen and moisture are contained in a large amount in a gas. The amount of impurities contained in the gas changes with a decrease in gas amount in the gas cylinder during use of the gas. For this reason, the time variation of the etching characteristics is caused. Materials causing heavy metal contamination and contained in the gas are deposited on an object to be etched to cause degradation of the performance of a semiconductor device to be processed, as in the above etching chamber.

In order to solve these problems, enhance the controllability of an etching reaction, and prevent the heavy metal contamination to a semiconductor device, it is developed that a gas itself is highly purified.

Moreover, to obtain a higher-purity supply gas, the inner surfaces of a vessel for containing the gas and components such as a gas pipe and a valve are polished. With this operation, the adsorption amount of an impurity gas is rapidly decreased.

Nowadays, since a gas is cleaned in this manner, the amount of a gas containing oxygen or moisture in a gas fed to an etching chamber in etching can be controlled to a very small amount on the ppm order or less.

As for a vacuum pump for exhausting an etching gas from an etching chamber, a turbo-molecular pump is introduced to abruptly improve the gas exhaust performance. With development of apparatus automation, a load lock system is generally used in which an object to be etched can be exchanged with another without setting the interior of an etching chamber to the outer atmosphere.

With the above arrangement, residual gas components in a gas of an etching chamber other than a gas fed for etching can be abruptly decreased in etching. In this manner, the controllability and reproducibility of etching can be more improved by performing etching in such a higher-purity atmosphere.

It has been turned out, however, that the high purification of an etching gas poses a new problem as follows. That is, if an etching gas wherein a gas containing oxygen or moisture is greatly decreased is used, a halogen element such as chlorine begins to react with an anodized aluminum chamber, which is conventionally considered not to occur. This reaction degrades the surface of the etching chamber. In addition, deposition of the reaction products on an object to be etched causes high-concentration contamination and degradation of processability such as the uniformity of an etching rate and a processed shape.

SUMMARY OF THE INVENTION

The present invention has been made to solve the above problems, and has as its object to provide a dry etching method in which a metal or metal compound constituting an etching chamber can be protected without degrading etching characteristics, and metal contamination does not occur from the etching chamber.

According to the first aspect of the present invention, there is provided a dry etching method comprising the steps of: loading an object to be etched in a low-pressure vapor phase processing chamber; feeding, to the low-pressure vapor phase processing chamber, an etching gas obtained by adding a small amount of additive gas of oxygen or additive gas at least containing oxygen to a reaction gas used for etching; and dry-etching a target object with the etching gas.

According to the second aspect of the present invention, there is provided a dry etching method comprising the steps of: loading an object to be etched in a low-pressure vapor phase processing chamber; feeding, to the low-pressure vapor phase processing chamber, an etching gas obtained by adding a small amount of additive gas of oxygen or additive gas at least containing oxygen to a reaction gas used for etching so as to suppress a reaction between a wall of the low-pressure vapor phase processing chamber and the reaction gas; and dry-etching the object to be etched with the etching gas.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
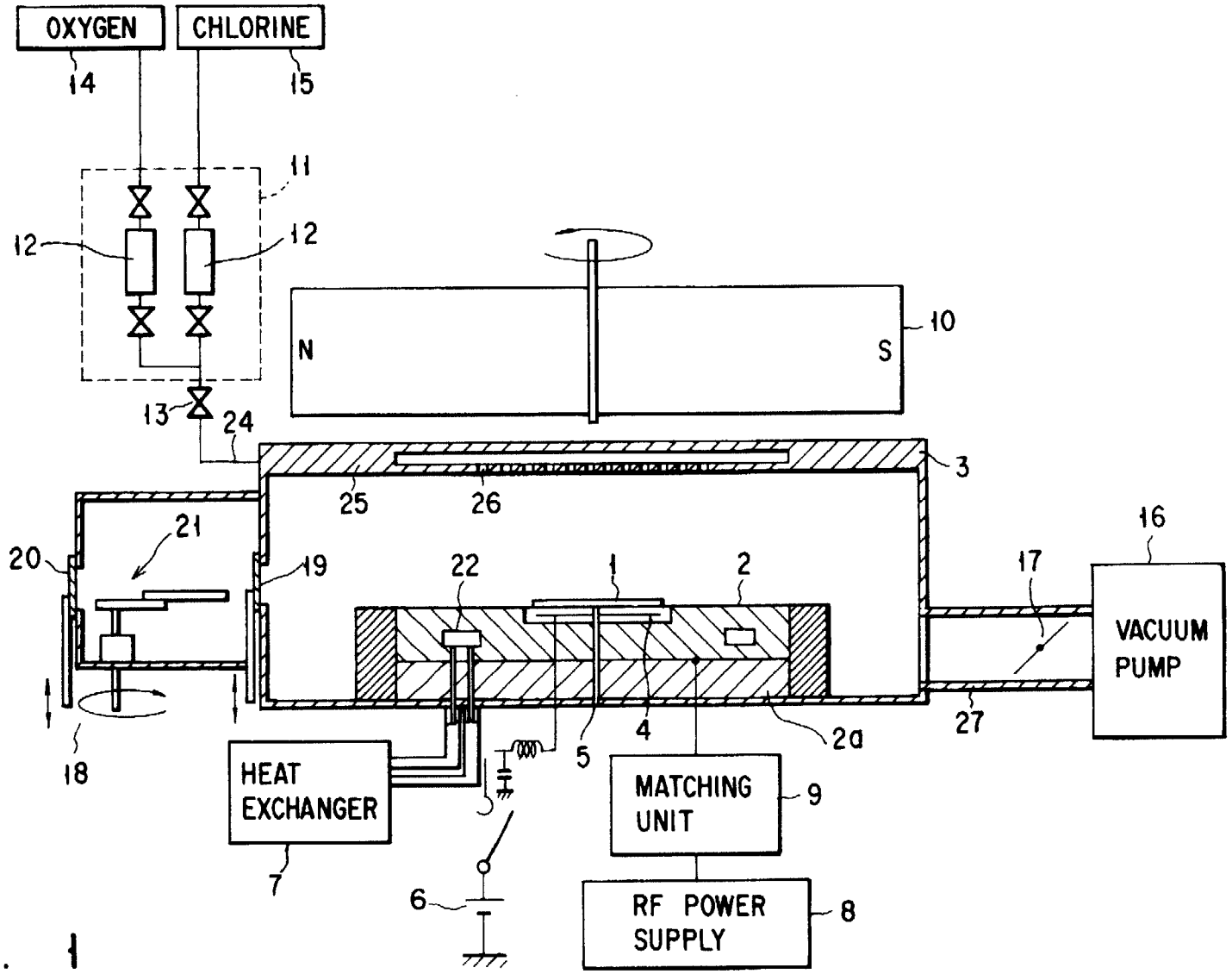
FIG. 1 is a view showing an arrangement of a reactive ion etching apparatus according to an embodiment.

A dry etching method according to the present invention utilizes the action that the presence/absence of oxygen in a very small amount greatly influences a reaction between a metal oxide and a halogen element gas or halogen-element-containing gas serving as a reaction gas.

A metal oxide such as alumina does not voluntarily react with a chlorine gas or the like regardless of the presence/absence of oxygen in many cases. This is also apparent from the calculation of a reaction equilibrium constant.

As an example, a reaction between chlorine and alumina formed on a surface obtained by anodizing an aluminum surface will be described below. The equilibrium state of this reaction is represented by formula (1) below:

$$6Cl_2[g]+2Al_2O_3[s]\rightarrow 2Al_2Cl_6[g]+3O_2[g] \quad (1)$$

The equilibrium constant of this formula at 25° C. is as small as $1.7\times10^{-127}$. This indicates that chlorine and alumina do not substantially voluntarily react with each other.

The situation, however, changes in a reaction between a chloride and alumina.

For example, in a reaction between boron chloride ($BCl_3$) and alumina, the equilibrium state is represented by formula (2) as follows:

$$4BCl_3[g]+2Al_2O_3[s]\longleftrightarrow 2B_2O_3[s] \quad (2)$$

The equilibrium constant of this formula at 25° C. is $1.2\times10^{15}$, and a voluntary reaction can occur.

Although the equilibrium constant of a reaction system between a chloride and alumina may be one or less depending on the types of chlorides, this equilibrium constant is much larger than that in the reaction system between chlorine and alumina. Even in this case, a reaction possibility is sufficiently high.

In dry etching, a gas is often excited with a plasma or light to generally accelerate the reaction. In this case, the excited gas is decomposed to generate a radical. The radical is highly chemically active and tends to change into another state upon an immediate reaction with another radical or a stable molecule. That is, the free radical easily reacts with a metal oxide. This can also be readily understood from the calculation of the equilibrium constant.

A reaction between a chlorine radical (Cl.) and alumina is taken as an example. The equilibrium state is represented by formula (3) as follows:

$$12Cl.[g]+2Al_2O_3[s]\rightarrow 2Al_2Cl_5[g]+3O_2[s] \quad (3)$$

The equilibrium constant of this formula at 25° C. is as very large as $2.7\times10^{95}$. This indicates that the chlorine radical tends to react with alumina.

The following phenomenon is known to occur in a plasma. An ion sheath is formed near the wall of an etching chamber, and ions generated by a plasma generated in the ion sheath are accelerated and bombarded against the wall surface. For this reason, the reaction is accelerated by this auxiliary ion effect.

When oxygen is present in an etching gas, oxygen is converted into an oxygen radical with a plasma or light. The calculation of the equilibrium constant in the system in which this oxygen radical is present in the gas derives a very interesting result.

More specifically, when a reaction between a chlorine radical and alumina in the presence of an oxygen racial as in the above case is taken as an example, the equilibrium state is represented by formula (4) below:

$$12Cl.[g]+2Al_2O_3[s]\rightarrow 2Al_2Cl_6[g]+6O.[g] \quad (4)$$

The equilibrium constant of this formula at 25° C. is as very small as $6.8\times10^{-149}$.

That is, as compared with formula (3), the reaction direction is perfectly reversed. When the oxygen radical is present in the gas system, the reaction between the chlorine radical and alumina is greatly suppressed.

This suppression effect is found to be large even in the presence of an OH radical in a gas. In this case, the equilibrium state is represented by formula (5), and the equilibrium constant of this formula at 25° C. is much smaller to be $1.5\times10^{-217}$:

$$6H_2O[g]+12Cl.[g]+2Al_2O_3[s]\rightarrow 2Al_2Cl_6[g]+12OH.[g] \quad (5)$$

As described above, when a chlorine gas or chlorine-containing gas is used as a reaction gas and oxygen is not added in the reaction gas, the reaction gas is decomposed and excited with a plasma or light. The excited reaction gas reacts with the etching chamber constituted by anodized aluminum, thereby corroding the etching chamber. An object to be etched is therefore contaminated with the resultant reaction products.

To the contrary, it is found that use of an etching gas obtained by adding a small amount of oxygen gas or a gas containing oxygen or moisture in the reaction gas causes generation of oxygen or OH radicals to suppress the above reaction.

In this case, the mixing flow rate of an oxygen gas or gas containing oxygen or moisture may be as very small as 1% or less of the total flow rate of the reaction gas in terms of flow rate, as will be understood from an embodiment to be described later. That is, a reaction between the anodized aluminum etching chamber and the reaction gas can be efficiently suppressed with an oxygen gas or gas containing oxygen or moisture in a flow rate of 1% or less of the total flow rate of the reaction gas.

The mechanism of the present invention has been described on the basis of the reaction between alumina and the chlorine radical by taking the etching chamber constituted by aluminum whose surface is anodized as an example. According to the present invention, a reaction between an etching chamber and a reaction gas can be suppressed with almost the same mechanism even if the etching chamber is constituted by another material.

For example, when an etching chamber is made of stainless steel, the surface of the etching chamber is normally mainly covered with chromium oxide.

The equilibrium state of a reaction between a chlorine radical and chromium oxide covering this surface is represented by formula (6) similar to formula (3) described above:

$$12Cl.[g]+2Cr_2O_3[s]\rightarrow 4CrCl_3[g]+3O_2[g] \quad (6)$$

The equilibrium constant of this formula at 25° C. is $7.6\times10^{70}$. This indicates that a reaction of generating chromium chloride ($CrCl_3$) is accelerated as in the reaction of alumina.

In contrast to this, when the oxygen radical is present in the reaction system, the equilibrium state is represented by formula (7) as follows:

$$12Cl.[g]+2Cr_2O_3[s]\rightarrow 4CrCl_3[g]+6O.[g] \quad (7)$$

The equilibrium constant of this formula at 25° C. is $1.9\times10^{-173}$. This reveals that the oxygen radical suppresses the reaction of generating chromium chloride as in the reaction of alumina described above.

Similarly, a reaction between the chlorine radical and silicon oxide can be suppressed by mixing an oxygen gas or gas containing oxygen or moisture with the reaction gas even if the material of the chamber is silicon oxide such as quartz.

In the above description, the chlorine gas or chlorine-containing gas is used as the reaction gas. If a bromine gas or bromine-containing gas is used as the reaction gas, a reaction with a metal oxide on the surface of the chamber can be similarly suppressed by mixing oxygen or moisture.

As an example, a reaction between the reaction gas and chromium oxide on the surface of the stainless steel etching chamber will be described. When the oxygen radical is not present, the equilibrium state can be established as represented by formula (8):

$$16Br.[g]+2Cr_2O_3[g]\rightarrow 4CrBr_4[g]+3O_2[g] \quad (8)$$

The equilibrium constant of this formula at 25° C. is $1.4\times10^{60}$. This indicates that the rightward reaction as in the case of chlorine, i.e., the reaction of generating chromium bromide ($CrBr_4$) is accelerated.

To the contrary, when the oxygen radical is present in this reaction system, the equilibrium state is represented by formula (9) as follows:

$$16Br.[g]+2Cr_2O_3[g]\rightarrow 4CrBr_4[g]+6O.[g] \quad (9)$$

The equilibrium constant of this formula at 25° C. is $3.6\times10^{-184}$. The reaction of generating chromium bromide can hardly progress, and the presence of the oxygen radical can suppress the reaction between the bromine radical and chromium oxide as in the above-mentioned case of the chlorine radical.

In addition to chlorine and bromine, as for a fluorine gas or fluorine-containing gas, a reaction with a metal constituting the etching chamber can be suppressed by mixing an oxygen gas.

As an example, when oxygen (oxygen radical) is not present upon a reaction between ferric oxide and a fluorine radical, the equilibrium state is represented by formula (10) as follows:

$$8F.[g]+2Fe_2O_3[s]\rightarrow 4FeF_2[g]+3O_2[g] \quad (10)$$

The equilibrium constant of this formula at 25° C. is $1.1\times10^{107}$. This reveals that the generation of ferric fluoride ($FeF_2$) progresses upon the reaction between ferric oxide and the fluorine radical.

In contrast, when the oxygen radical is present in this reaction system, the equilibrium state is represented by formula (11):

$$8F.[g]+2Fe_2O_3[s]\rightarrow 4FeF_2[g]+6O.[g] \quad (11)$$

The equilibrium constant of this equilibrium at 25° C. is $2.8\times10^{-137}$. This indicates that the presence of the oxygen radical suppresses the reaction of generating ferric fluoride as in the case of other halogen elements.

As described above, a halogen radical is generally highly reactive with a metal used as the wall material of the etching chamber or a metal compound represented by a metal oxide to form a metal halide.

If this metal halide is volatile, it easily evaporates upon a reaction, and the wall of the etching chamber is etched.

However, when an oxygen radical is present, a normal metal tends to be oxidized, and the oxidation reaction occurs easier than the halogenation reaction. Therefore, the presence of an oxygen radical in a very small amount can suppress reactions between the halogen radicals and various metals or metal compounds.

Note that such an effect cannot be expected when an acid halide is generated and consists of a highly volatile metal.

A preferred embodiment of the dry etching method according to the present invention will be described below with reference to the accompanying drawings.

FIG. 1 is a schematic view showing an arrangement of a reactive ion etching apparatus for performing the present invention.

A cathode electrode 2 is arranged in a vacuum chamber 3 such that it is supported by an electrode support base 2a. An object 1 to be etched is placed on the cathode electrode 2. The vacuum chamber 3 functions as an anode electrode and is formed of aluminum whose surface is alumite-treated (anodized).

The cathode electrode 2 has, at its central portion, a helium gas feed path 5 extending upward from a lower portion, through which a helium gas can be supplied from a helium gas source (not shown) to the lower side of the object 1. This helium gas improves heat contact between the cathode electrode 2 and the object 1.

An electrostatic chuck electrode 4 is buried in the cathode electrode 2 and an insulator covers the electrostatic chuck electrode 4. A high-voltage power supply 6 is connected to the electrostatic chuck electrode 4. In etching, the high-voltage power supply 6 applies a DC voltage to the electrostatic chuck electrode 4 to attract the object 1 to the electrostatic chuck electrode 4. This arrangement also improves the heat contact between the object 1 and the cathode electrode 2.

The cathode electrode 2 has a structure wherein a refrigerant is circulated by heat exchanger 7. That is, the refrigerant flows from the heat exchanger 7 to a refrigerant passage 22 through a refrigerant pipe 23. Since the heat contact between the cathode electrode 2 and the object 1 is improved as described above, the object 1 can be cooled by flowing the refrigerant in the cathode electrode 2. The refrigerant is temperature-adjusted by the heat exchanger 7 and circulates in the cathode electrode 2 to keep the cathode electrode 2 at a constant temperature. This embodiment uses a fluorocarbon-based liquid as the refrigerant, which can cool the cathode electrode 2 at a constant temperature within −30° C. to 20° C.

An RF power supply 8 is connected to the cathode electrode 2 via a matching unit 9, and RF power is supplied from the RF power supply 8 to the cathode electrode 2. Various types of RF frequencies can be applied, but this embodiment uses 13.56 MHz.

To generate a high-density plasma and realize high-rate etching, a permanent magnet 10 is provided immediately above the vacuum chamber 3 in this apparatus. Discharge generating between the cathode electrode 2 and the chamber 3 as an anode electrode is of a magnetron type due to a magnetic field generated by the permanent magnet 10. In etching, the permanent magnet 10 is rotated to increase the uniformity of the magnetic field.

An oxygen source 14 and a chlorine source 15 are connected to the vacuum chamber 3 via a gas feed unit 11 and a pipe 24. An oxygen gas and a chlorine gas can be fed from these sources to the vacuum chamber 3. The gas flow rates at this time are adjusted by mass-flow controllers 12 in the gas feed unit 11.

When a gas is to be fed to the vacuum chamber 3, a gas feed valve 13 is opened, and then the gas is fed to the vacuum chamber 3 via a gas passage 25 thereof and a plurality of holes 26 in the upper portion thereof.

The interior of the vacuum chamber 3 is evacuated by a vacuum pump 16 via an exhaust pipe 27. At this time, a gas pressure (vacuum degree) in the vacuum chamber 3 can be kept at a predetermined set value by adjusting the opening degree of a throttle valve 17 in the exhaust pipe 27.

Further, a load lock chamber 18 is provided to the apparatus of this embodiment so as not to decrease the vacuum degree in the vacuum chamber in exchange of the objects 1. The load lock chamber 18 is connected to the vacuum chamber 3 via a gate valve 19 and to the outer atmosphere via a gate valve 20. A convey robot 21 for automatically conveying the object 1 is arranged in the load lock chamber 18.

An etching operation of the reactive ion etching apparatus in FIG. 1 having the above arrangement will be described hereinafter. As an example of the present invention, a case will be exemplified in which a patterned organic resist film is used as a mask, and gate electrode consisting of a phosphorus-doped polysilicon film is to be etched.

First, the interior of the vacuum chamber 3 is evacuated to $10^{-3}$ Pa or less by the vacuum pump 16. The cathode electrode 2 is cooled and kept at −30° C. by the heat exchanger 7.

After the load lock chamber 18 is set to atmospheric pressure, the gate valve 20 is opened, and the object 1 is conveyed to the load lock chamber 18 by the convey robot 21. Then, the gate valve 20 is closed, and the interior of the load lock chamber 18 is evacuated.

Thereafter, the gate valve 19 is opened, the object 1 is placed on the electrostatic chuck electrode 4 of the cathode electrode 2, and the gate valve 19 is closed.

With this operation, the interior of the vacuum chamber 3 can be kept at a high-vacuum degree without almost changing the vacuum degree before/after loading of the object 1.

The object 1 is a sample on which a resist pattern is formed as follows. That is, a silicon oxide insulating film is formed on a silicon wafer on which a semiconductor element is to be formed, phosphorus-doped polysilicon is deposited thereon, and an organic resist film is coated. Thereafter, the organic resist film is partially removed in an exposure/developing step to form the resist pattern with the remaining resist.

Assume that etching is performed using only the chlorine gas as a reaction gas. After the object 1 is placed on the cathode electrode 2, the gas feed valve 13 between the gas feed unit 11 and the vacuum chamber 3 is opened to feed the chlorine gas as the reaction gas for etching from the chlorine source 15. The gas flow rate at this time is accurately controlled by the mass-flow controller 12, e.g., the chlorine gas is controlled to a flow rate of 100 sccm.

The pressure in the vacuum chamber 3 is controlled to, e.g., 12 Pa by adjusting the throttle valve 17 while the permanent magnet 10 is rotated.

Next, the high-voltage power supply 6 applies, e.g., 1,000V to the electrostatic chuck electrode 4. At the same time of the RF application, the helium gas is fed to the lower side of the object 1 via the helium gas feed path 5.

In this state, RF power is applied from the RF power supply to the cathode electrode 2. Glow discharge is generated in the vacuum chamber 3 upon this RF power application. This decomposes and ionizes the etching gas, and accelerated ions and reactive radicals reach the object 1 to etch the exposed polysilicon film on the object 1.

Upon etching, the object 1 is unloaded to the outer atmosphere in a reverse order of loading to keep the vacuum degree.

Note that all the operations are automatically performed under the control of a microprocessor.

Figure 2:
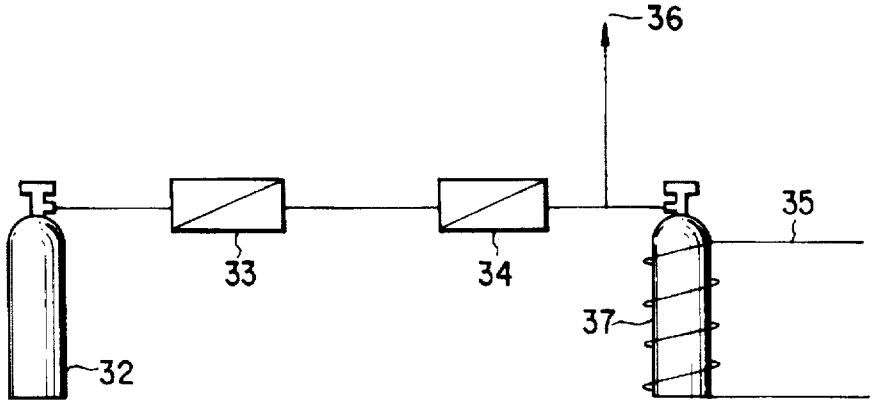
FIG. 2 is a view for explaining a cold-purifying/filling method.

The chlorine gas used in this embodiment is generated according to a cold-purifying filling method as shown in FIG. 2. According to this purifying filling method, chlorine is gasified from a chlorine curdle 32, and impurities such as moisture and an organic substance and particles in the gas are removed through an impurity adsorption cylinder 33 and a filter 34. Thereafter, the obtained gas is liquefied and filled in a stainless steel cylinder 37 which is cooled by a cooling pipe 35 and has an polished inner surface. The chlorine gas has a purity of 99.999%.

The characteristic feature of this filling method is that the residual water content is very lower than that of a conventional gas. Actual analysis of the residual amounts of moisture and oxygen in the gas resulted in 1 ppm or less and 2 ppm or less, respectively. Note that, in FIG. 2, reference numeral 36 denotes a bent line for exhausting an excessive gas or the like.

The above etching processing was performed several times by using this chlorine gas to observe a phenomenon in which the in-plane uniformity of an etching rate was gradually degraded. This phenomenon is shown in FIG. 3.

Figure 3:
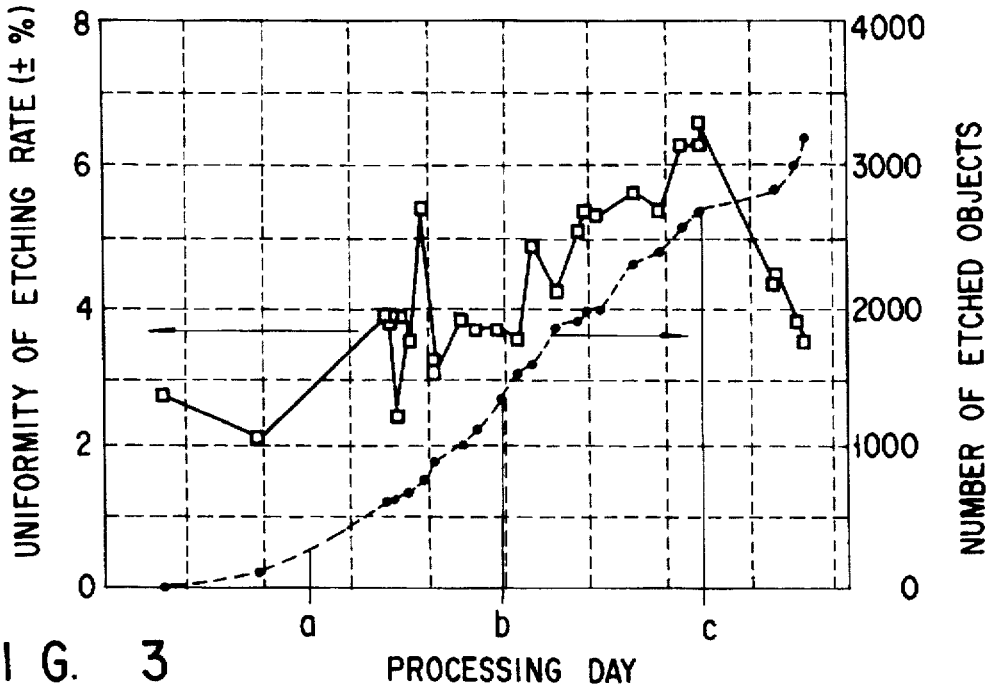
FIG. 3 is a graph showing a relationship between processing days and the number of etched objects and a relationship between the processing days and the uniformity of an etching rate.

FIG. 3 is a graph showing a relationship between processing days and the number of etched targets and a relationship between the processing days and the uniformity of an etching rate, in which the abscissa indicates the processing days and the ordinate indicates the number of etched objects and the uniformity of the etching rate. In this graph, squares indicate the uniformity of the etching rate, and solid circles indicate the number of etched objects.

As shown in FIG. 3, the uniformity was significantly degraded to a point (c) with an increase in the number of etched objects. This degradation was caused due to a gradual decrease in etching rate at the peripheral portion of the object 1.

The shape of a polysilicon film upon processing was examined with a scanning electron microscope. FIGS. 4A to 4D are sectional views showing processed shapes at that time.

Figure 4A:
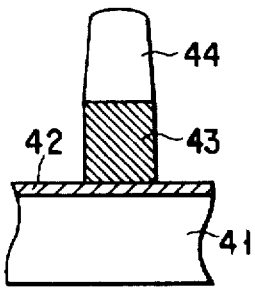
FIGS. 4A to 4D are sectional views showing the shapes of etched objects.
Figure 4B:
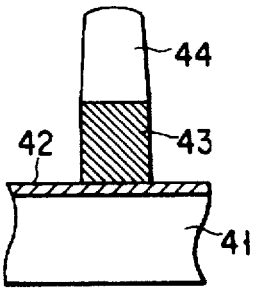

Of these drawings, FIGS. 4A and 4B respectively show a processed shaped at the center of the object and that at its peripheral portion at a point (a) in FIG. 3. Each phosphorus-doped polysilicon pattern 43 on a silicon wafer 41 having a silicon oxide insulating film 42 thereon, which pattern was formed using a resist pattern 44 as a mask, had a vertical side wall. There was little processed shape difference between the center and the peripheral portion.

Figure 4C:
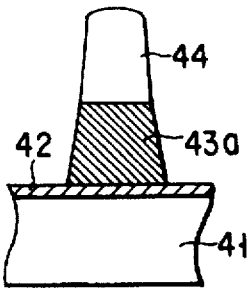
Figure 4D:
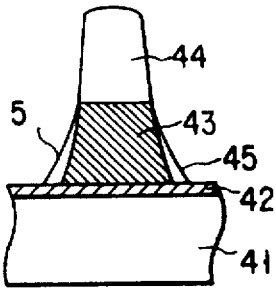

In contrast to this, as shown in FIG. 4C, the processed shape at the central portion of the target was a tapered phosphorus-doped polysilicon pattern 43 at a point (b) in FIG. 3. Depositions 45 on the side walls of the phosphorus-doped polysilicon pattern 43*a* were observed particularly at the peripheral portion as shown in FIG. 4D.

When this phosphorus-doped polysilicon pattern is used as the gate electrode of a MOS semiconductor device, this tapered shape, and particularly a shape difference between the central and peripheral portions increase a variation range of the characteristics of the semiconductor device. This greatly degrades the performance of the semiconductor device.

Figure 5:
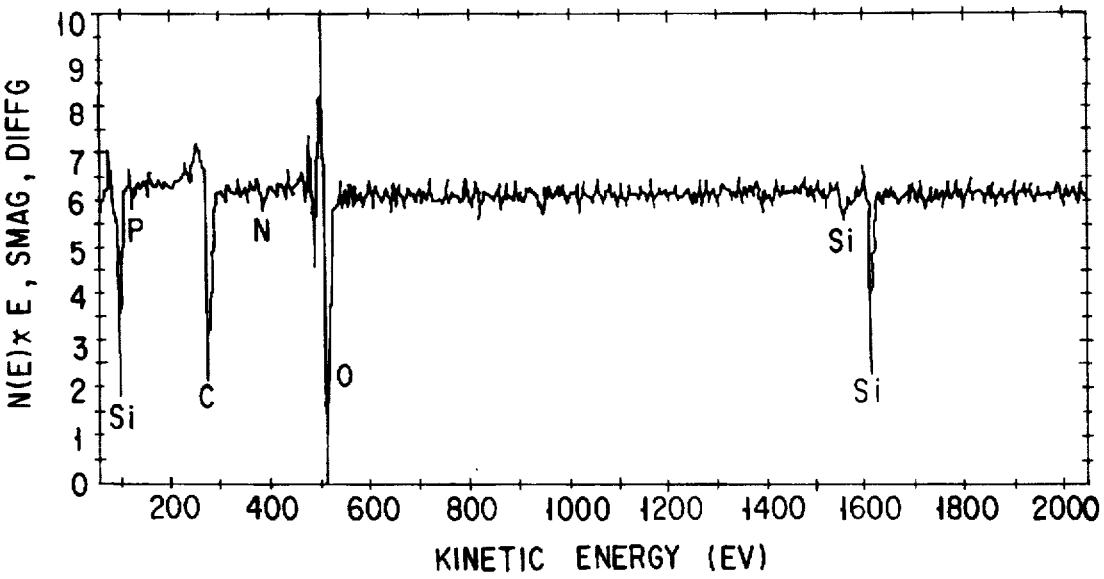
FIG. 5 is a spectral chart showing the result obtained by examining the side wall of a phosphorus-doped polysilicon pattern by the Auger electron spectroscopy when the processed side wall has a vertical shape.
Figure 6:
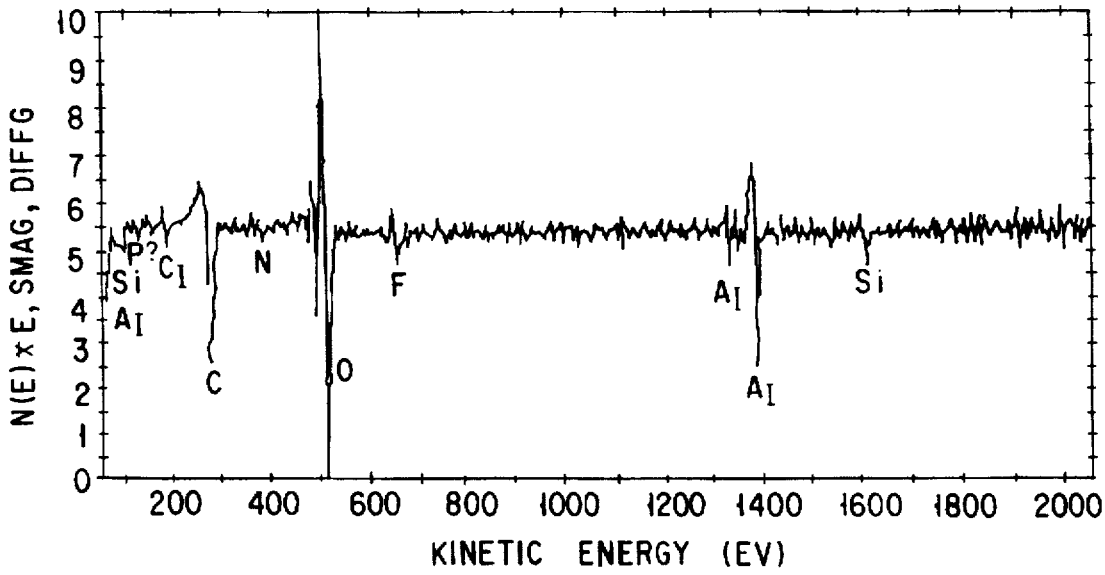
FIG. 6 is a spectral chart showing the result obtained by examining the side wall of a phosphorus-doped polysilicon pattern by the Auger electron spectroscopy when the processed side wall has a tapered shape.

The components of the above depositions 45 were examined by the Auger electron spectroscopy. FIGS. 5 and 6 are spectral charts showing results obtained by examining the side walls of the above phosphorus-doped polysilicon pattern by the Auger electron spectroscopy.

FIG. 5 shows the analysis result of a sample at a point wherein the etched object has a vertical shape, i.e., the point (a) in FIG. 3. Silicon, oxygen, and carbon were mainly detected, and there was no difference between the analysis result and a normal result.

To the contrary, FIG. 6 shows the analysis result of a sample at a point wherein the etched object has a tapered shape, i.e., the point (b) in FIG. 3. In this case, aluminum was detected which was not detected normally, and it was confirmed that the cause for the tapered shape was contamination of the object with aluminum.

The vacuum chamber 3 is formed of aluminum in the apparatus, as described above. The surface of the vacuum chamber 3 is formed of alumina obtained by anodizing aluminum. It is assumed that this surface reacts with a chlorine radical to generate aluminum chloride, and it is deposited on the surface of the cooled object 1 to cause the contamination.

As shown in FIG. 3, this contamination progresses gradually. Judging from this, it is assumed that moisture and oxygen adsorbed to the wall of the gas system pipe are gradually exhausted with use of the gas, gradually increasing the actual purity of the gas fed to the vacuum chamber 3.

When the chlorine source 15 was replaced with an iron cylinder which was not subjected to cold-purifying filling, the uniformity of the etching rate was gradually improved from the point (c) in FIG. 3.

From these results, residual oxygen and moisture in the chlorine gas highly effectively prevent aluminum contamination. For this reason, oxygen was attempted to be positively added in an etching gas.

As an etching gas, a cold-purified gas in a stainless steel cylinder again was used.

The etching procedure in this case was the same as described above. According to this procedure, the valves in the gas feed unit 11 not only on the line of the chlorine source 15 but also on the line of the oxygen source 14 were opened, and the mixing amount of an oxygen gas in a chlorine gas was accurately controlled by the mass-flow controllers 12.

In this example, the chlorine gas was set at a constant flow rate of 100 sccm, and the oxygen gas was added to the chlorine gas in a very small amount.

In this case, the oxygen mass-flow controller 12 had a maximum flow rate of 1 sccm. Other conditions were the same as in the above example.

Figure 7:
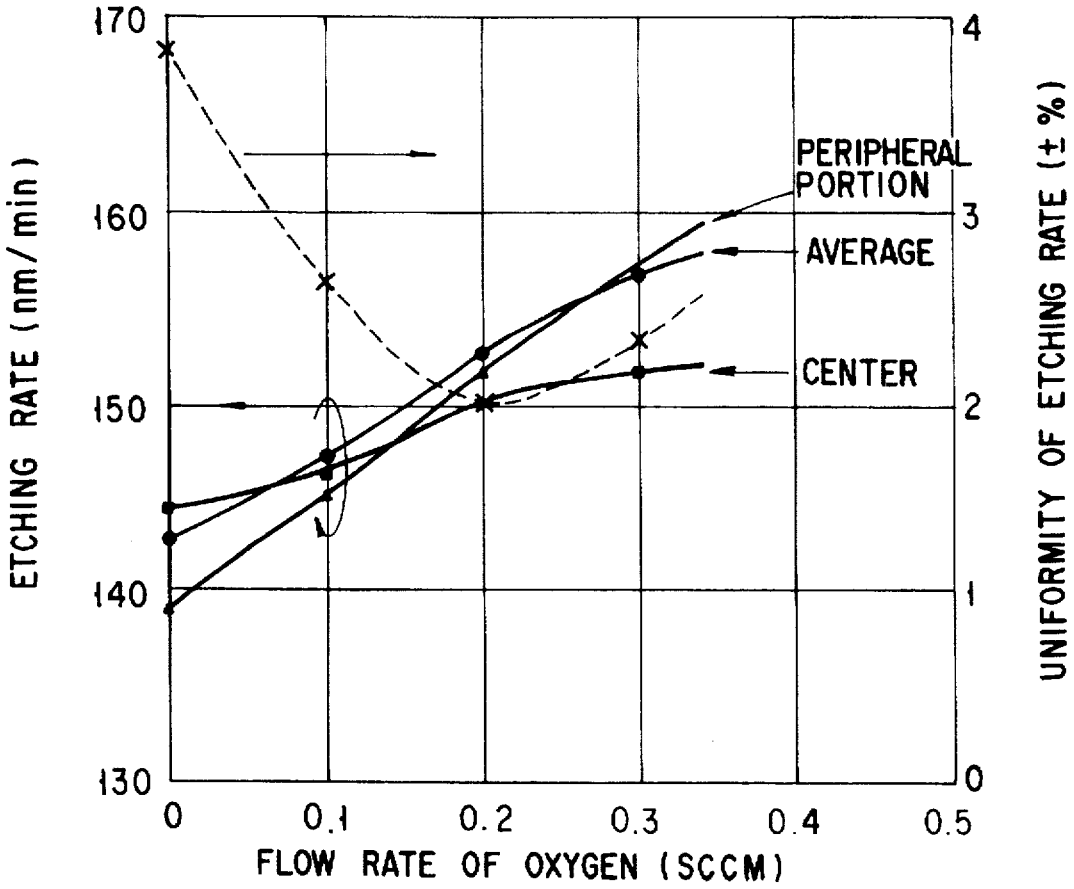
FIG. 7 is a graph showing a relationship between the flow rate of oxygen to be added and an etching rate and a relationship between the flow rate of oxygen to be added and the uniformity of the etching rate.

FIG. 7 is a graph showing a relationship between the flow rate of oxygen to be added and an etching rate and a relationship between the flow rate of oxygen to be added and the uniformity of the etching rate. Referring to FIG. 7, the etching rate shows the average of etching rates at the center and peripheral portion of an object to be etched.

As shown in FIG. 7, the etching rate increases with an increase in flow rate of oxygen. When oxygen is not fed, the etching rate at the peripheral portion is higher than that at the center; when oxygen is fed, the etching rate at the peripheral portion increases with an increase in oxygen content to improve the uniformity of the etching rate.

If, however, the flow rate of oxygen is set at 0.3 sccm, the etching rate at the peripheral portion is higher to undesirably degrade the uniformity.

The above oxygen flow rate dependency can be explained as follows.

More specifically, when oxygen is absent, alumina formed on the wall surface of the vacuum chamber 3 reacts with a chlorine radicals and is etched. In particular, drifting electrons upon magnetron discharge collide with the side wall of the vacuum chamber 3 every rotation of the permanent magnet 10. The side wall of the vacuum chamber 3 contacts a higher-density plasma, and both the radical density and the ion bombardment amount are large at this time. Therefore, the loss of alumina becomes large.

Therefore, many of the reaction products mainly containing aluminum chloride reach and is deposited on the object 1 from the peripheral portion of the vacuum chamber. The reaction products are deposited on the object 1 to decrease the etching rate particularly at the peripheral portion of the object 1.

In contrast to this, when oxygen is added, a reaction between a chlorine radical and alumite (alumina) is suppressed. The amount of reaction products decreases, and thus the deposition of the reaction products on the object 1 decreases. Therefore, the etching rate at the peripheral portion of the object 1 is increased to a normal rate, improving the uniformity of the etching rate.

Note that, once oxygen is supplied to the vacuum chamber 3, oxygen adsorbed to the interior of the vacuum chamber 3 and the like suppress the reaction between the chlorine radical and anodized aluminum for a while even if oxygen is not added to an etching gas.

Judging from this, the following is confirmed as shown in FIG. 3. That is, moisture and oxygen adsorbed to the gas system pipe, which are the cause for the degradation of the uniformity of the etching rate, are gradually exhausted with use of the gas. Therefore, the actual purity of the gas fed to the vacuum chamber 3 gradually increases.

The oxygen-addition effect for the processed shape of the phosphorus-doped polysilicon was confirmed to obtain the following results. That is, when no oxygen was added or oxygen was mixed at 0.1 sccm, the depositions 45 shown in FIG. 4D were observed at the side walls of the formed pattern at the peripheral portion of the object, and the shape of the side walls was tapered. When oxygen was mixed at 0.2 sccm, the deposition to the side walls of the formed pattern was not observed, and the side walls had an almost vertical shape as shown in FIG. 4A. In this case, a shape difference between the central and peripheral portions of the object 1 was practically canceled.

This reveals that oxygen must be added at 0.2% or more the flow rate of the reaction gas in order to prevent the reaction between the chlorine radical and alumina on the chamber surface.

Figure 8:
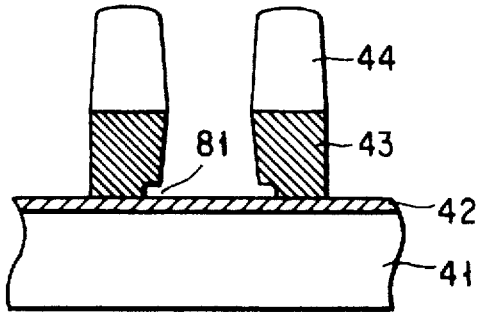
FIG. 8 is a sectional view showing the shape of an etched object on which abnormal side etching has occurred.

A processed shape upon oxygenation at 0.3 sccm was examined to observe no deposition on the side walls. As shown in FIG. 8, however, side walls of a phosphorus-doped polysilicon pattern 43*b* facing a very narrow space so as to interpose it therein were reversely tapered. Furthermore, as shown in FIG. 8, abnormal side etching 81 occurred at an interface between the phosphorus-doped polysilicon pattern 43*b* and the silicon oxide insulating film 42.

In this dry etching, generally, the resist pattern 44 as a mask is slightly etched. Products generated by this etching are deposited on the side walls of a formed pattern to suppress etching of the side wall portions of the formed pattern and prevent side etching. For this reason, a vertical processed side wall can be obtained.

When oxygen was added too much, however, the organic deposition film on the side wall portions of the formed pattern was also removed, failing to prevent side etching. Therefore, the above abnormal side etching 81 occurred.

When the oxygen content was further increased, a reversely tapered shape and abnormal side etching were observed on a pattern having a wider space therein.

This indicates that there may be a case wherein oxygen adversely affects other characteristics for processing a pattern if oxygen is merely added without being suppressed to a minimum amount required for suppressing a reaction between a chlorine radical and alumite (alumina). In the above example, it is optimum to add oxygen at 0.2 sccm, i.e., to mix it at about 0.2% of the total amount of the reaction gas.

The above iron cylinder which is not subjected to cold-purifying filling has the same effect as in oxygen mixture owing to residual moisture and oxygen of this cylinder. The residual amount is about 0.03 sccm in terms of oxygen when it is estimated from the etching rate, uniformity of the etching rate, and processed shape of polysilicon. By this amount, a reaction between a chlorine radical and alumite (alumina) cannot be suppressed.

It is known that the content of impurities such as moisture in a gas changes in accordance with a residual gas amount in the cylinder which is not cleaned in this manner. It is reported that, particularly moisture increases with a decrease in residual gas amount, and when there is little residual gas amount in the cylinder, the content of moisture reaches several times the initial amount.

Since this variation results in a variation of the uniformity of the etching rate and a change in processed shape, it becomes an important variation factor for the performance and yield of a semiconductor device to be manufactured.

To maximize the effect of the present invention, therefore, it is preferable to use a gas having a purity as high as possible and filled in a cylinder whose inner surface hardly adsorbs the gas, and to mix a very small amount of oxygen-containing gas by controlling its flow rate.

This embodiment uses oxygen for preventing the reaction between the chlorine radical and alumite (alumina). Needless to say, the same effect can be obtained if an oxygen-containing compound gas or gas mixture of oxygen and another gas is added.

For example, when air was used in place of oxygen in the above embodiment, the same effect could be obtained. Air addition amount at this time was optimally 0.7 sccm.

This amount corresponds to 0.14% of the total flow rate in oxygen conversion.

A case of adding moisture can obtain the same effect at a smaller flow ratio. However, moisture is not suitable because it is highly adsorbed to the etching chamber to degrade the controllability.

In order to enhance the controllability, it is most effective to dilute oxygen with a rare gas. For example, in the above embodiment, when a gas added with 10% oxygen is mixed with helium, it is optimal to add oxygen at 2 sccm.

As other gas species to be mixed, carbon dioxide and $N_2O$ are proper in view of the controllability and easy handling of a gas.

In this manner, a sufficient addition amount of the oxygen-containing gas is 1% or less of the total flow rate of the reaction gas in terms of an oxygen amount.

The above embodiment exemplifies the oxygen-addition effect for preventing the reaction between the chlorine radical and alumina. As another embodiment, etching of a polysilicon film with an ECR etching apparatus having a stainless steel chamber covered with chromium oxide can be considered.

This case generally uses hydrogen bromide for an etching gas. When etching was performed using high-purity hydrogen bromide, the surface of an object to be etched was contaminated by high-concentration chromium, greatly degrading the characteristics of a semiconductor device using this.

The chromium concentration on the surface of the object was measured using a total reflection fluorescent X-ray apparatus to find a contamination amount of $2\times10^{12}$ $cm^{-1}$.

Like the above embodiment, etching was performed using a gas obtained by adding 0.3-sccm oxygen to a 40-sccm etching gas. As a result, a reaction between chromium oxide and a bromine radical could be suppressed to suppress the chromium contamination concentration to $1\times10^{11}$ $cm^{-1}$ or less.

Moreover, oxygen-addition has a great effect for preventing contamination caused by a reaction between a metal or metal compound constituting a chamber and a halogen radical in a combination of an anodized aluminum chamber and boron chloride or hydrogen bromide, and a combination of a stainless steel chamber and chlorine or hydrogen fluoride.

As has been described above, according to the present invention, a small amount of oxygen gas or oxygen-containing gas is added in a high-purity reaction gas. This oxygenation can prevent changes in etching rate and uniformity thereof, over time, which are caused in a conventional uncontrolled state. This can also prevent metal contamination of the constituent material of the etching chamber and a variation of the processed shape on the substrate surface as a processing target.

Therefore, use of the present invention can improve the performance of an LSI or another semiconductor device which uses this etching method as some of manufacturing processes, and the yield can be increased by preventing a time variation of process conditions.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method for etching an object in a low-pressure vapor phase processing chamber and a reaction gas comprising the steps of:

i) purifying a reaction gas into a high purity reaction gas and storing the resultant high purity reaction gas in a first source, ii) feeding said high purity reaction gas from said first source into a low-pressure vapor phase processing chamber which has a metal wall whose inner surface is exposed to plasma generated in said processing chamber;

iii) feeding an additive gas of oxygen or additive gas at least containing oxygen in an amount effective to suppress a reaction between said high purity reaction gas and a metal wall of said processing chamber from a second source into said processing chamber, high purity reaction gas and additive gas constituting an etching gas; and iv) dry etching an object in said processing chamber with plasma of said etching gas.

2. The method according to claim 1, wherein said purifying step is a cold-purifying process and said first source is a stainless steel cylinder.

3. The method according to claim 2, wherein said high purity reaction gas has a purity of 99.999%.

4. A method according to claim 1, wherein a flow rate of oxygen contained in the additive gas is not more than 1% of the total flow rate of the reaction gas.

5. A method according to claim 1, wherein the reaction gas contains a halogen element.

6. A method according to claim 1, wherein the additive gas is at least one gas mixture selected from the group consisting of a gas mixture of oxygen and nitrogen, a gas mixture of oxygen and a rare gas, and a gas mixture with a water vapor.

7. A method according to claim 1, wherein a surface of said object to be etched is formed of polysilicon or a metal.

8. A method according to claim 1, wherein said low-pressure vapor phase processing chamber is formed of aluminum whose surface is anodized.

9. A method according to claim 1, wherein said low-pressure vapor phase processing chamber is formed of stainless steel.

10. A method for etching an object in a low-pressure vapor phase processing chamber and a reaction gas comprising the steps of:

i) purifying chlorine gas into a high purity chlorine gas by removing moisture and organic substances and particles from chlorine gas and storing said high purity chlorine gas in a stainless steel cylinder;

ii) feeding said high purity chlorine gas from said stainless steel cylinder into a low-pressure vapor phase processing chamber which has an aluminum wall whose inner surface is anodized and exposed to plasma generated in said processing chamber;

iii) feeding an additive gas of oxygen or additive gas at least containing oxygen in an amount effective to suppress a reaction between said high purity chlorine gas and said aluminum wall of said processing chamber from a second source into said processing chamber, said high purity chlorine gas and additive gas constituting an etching gas; and iv) dry etching an object in said processing chamber with plasma of said etching gas.

11. A method for etching an object in a low-pressure vapor phase processing chamber and a reaction gas comprising the steps of:

i) purifying a halogen gas into a high purity halogen gas and storing the resultant high purity halogen gas in a first source;

ii) feeding said high purity halogen gas from said first source into a low-pressure vapor phase processing chamber which has an inner surface made of alumina, chromium oxide or silicon exposed to plasma generated in said processing chamber;

iii) feeding a an additive gas of oxygen or additive gas at least containing oxygen in an amount effective to suppress a reaction between said high purity halogen gas and said inner surface of said processing chamber from a second source into the processing chamber, high purity reaction gas and additive gas constituting an etching gas; and iv) dry etching an object in said processing chamber with plasma of said etching gas.

* * * * *